United States Patent [19]

Stadler

[11] Patent Number: 4,783,956

[45] **Date of Patent: * Nov. 15, 1988**

[54] METHOD AND APPARATUS FOR PRODUCING A YARN

[75] Inventor: Herbert Stadler, Kollbrunn, Switzerland

[73] Assignee: Rieter Machine Works Limited, Winterthur, Switzerland

[ * ] Notice: The portion of the term of this patent subsequent to Apr. 28, 2004 has been disclaimed.

[21] Appl. No.: 941,981

[22] Filed: Dec. 15, 1986

Related U.S. Application Data

[63] Continuation of Ser. No. 734,845, May 15, 1985, Pat. No. 4,660,371.

[30] Foreign Application Priority Data

May 18, 1984 [CH] Switzerland ..... 2450/84

[51] Int. Cl.[4] ..... D01H 7/892

[52] U.S. Cl. ..... 57/401; 57/331; 57/408

[58] Field of Search ..... 57/401, 400, 412, 413, 57/328, 5, 331, 334, 408, 409, 410, 411

[56] References Cited

U.S. PATENT DOCUMENTS

| | | | |
|---|---|---|---|
| 3,145,428 | 8/1964 | Reiterer et al. | 19/106 R |
| 3,555,802 | 1/1971 | Maxham | 57/401 X |
| 3,636,693 | 1/1972 | Benson et al. | 57/401 |
| 4,067,181 | 1/1978 | Fehrer | 57/401 X |
| 4,070,811 | 1/1978 | Fehrer | 57/401 |
| 4,109,454 | 8/1978 | Fehrer et al. | 57/401 |
| 4,334,400 | 6/1982 | Fehrer | 57/401 X |
| 4,392,343 | 7/1983 | Parker et al. | 57/401 |
| 4,420,928 | 12/1983 | Fehrer | 57/401 |
| 4,524,580 | 6/1985 | Fehrer | 57/401 |
| 4,660,371 | 4/1987 | Stalder | 57/401 |

FOREIGN PATENT DOCUMENTS

| | | | |
|---|---|---|---|
| 1902111 | 9/1969 | Fed. Rep. of Germany . | |
| 2943063 | 5/1980 | Fed. Rep. of Germany . | |
| 1490473 | 6/1967 | France . | |
| 2339687 | 8/1977 | France . | |
| 2480799 | 10/1981 | France . | |
| 106529 | 6/1984 | Japan . | |
| 1208264 | 10/1970 | United Kingdom . | |
| 1231198 | 5/1971 | United Kingdom | 57/401 |

*Primary Examiner*—Stuart S. Levy
*Assistant Examiner*—Joseph J. Hail, III
*Attorney, Agent, or Firm*—Werner W. Kleeman

[57] ABSTRACT

In a method and an apparatus for producing a yarn by means of friction spinning drums, a fiber sliver is transformed into a body of fibers and transferred to a first perforated friction spinning drum of such friction spinning drums. At this first perforated friction spinning drum, the fibers are entrained by a suction air stream, produced by a suction passage located in the first perforated friction spinning drum, and are then fed into a converging space formed by and between the friction spinning drums. In this converging space the fibers are twisted into a spun yarn. The spun yarn is withdrawn by withdrawal rollers located near end faces of the friction spinning drums. The suction air stream required for entraining or catching the fibers is limited by walls forming the suction passage. The advantage of this apparatus is that the fibers are mechanically guided over the whole length of their travel path, i.e. from the body of fibers to the twisted yarn. As a result, the fibers never swim freely.

23 Claims, 5 Drawing Sheets

METHOD AND APPARATUS FOR PRODUCING A YARN

CROSS-REFERENCE TO RELATED APPLICATION

This application is a continuation of the commonly assigned, copending U.S. patent application Ser. No. 734,845, filed May 15, 1985 and entitled: "METHOD AND APPARATUS FOR PRODUCING A YARN", now U.S. Pat. No. 4,660,371, granted Apr. 28, 1987.

BACKGROUND OF THE INVENTION

The present invention relates to a new and improved method and apparatus for production of a yarn or the like by means of friction spinning equipment or friction spinning means.

Generally speaking, the inventive method for the production of a yarn or the like by friction spinning means contemplates separating the fibers from a body of fibers and such separated fibers are transferred to the friction spinning means to form a spun yarn, and this spun yarn is withdrawn in a direction defined or governed by the friction spinning means.

The apparatus of the present invention for the production of a yarn or the like comprises means for delivering fibers from a body of fibers, friction spinning means for receiving or taking-up the delivered fibers and for forming therefrom a spun yarn, and means for withdrawing the spun yarn.

Friction spinning is a spinning process in which fibers are separated from a fiber body, delivered to a moving perforated surface and twisted together thereon to form a spun yarn. A suction air stream passes through the moving perforated surface in a predetermined region or zone thereof, so that the fibers delivered to this predetermined region of the moving perforated surface are entrained in the suction air stream, moved onto the moving perforated surface, transported thereon to the end of this predetermined region, as viewed in the direction of movement of the moving perforated surface, and are thereafter twisted into a yarn. Twisting-in of the fibers is caused by the portion of the air stream or flow which, in this end region of the air stream or flow, is directed opposite to the direction of movement of the moving perforated surface and which thus catches fibers lying on the moving perforated surface and continually twists them into the yarn.

Due to the continuous withdrawal of the twisted fibers, which withdrawal also constitutes an aspect of the aforementioned friction spinning process, a spun yarn is produced with true twist.

From German Published Pat. No. 1,902,111, published Sept. 4, 1969, there is known to the art both a method and an apparatus by means of which a yarn of the type mentioned above is produced.

In this prior art method, fibers are separated by a toothed roller from a body of fibers and are transferred to an air stream passing around this toothed roller. In this air stream, the fibers are turned from a position oriented in the peripheral direction of the toothed roller into a position oriented substantially parallel to the axis of rotation of such toothed roller. After these fibers have reached the aforementioned position which is disposed parallel to the axis of rotation of the toothed roller, they are transferred to a suction drum. On the surface of this suction drum the fibers are transported, while still in a position disposed substantially parallel to the axis of rotation of the suction drum, to the previously described end or boundary region of such a suction air stream or flow, and, as likewise previously described, are twisted together and withdrawn by appropriate withdrawal means as a spun yarn. Twisting of the fibers into the yarn is assisted by an additional roller or roll extending parallel to the suction drum and almost contacting the suction drum. Accordingly, the directions of movement of the two last-mentioned rollers or rolls are opposite to one another at their region of closest approach, that is to say, the directions of rotation of both rollers or rolls are the same.

It is a considerable disadvantage of this prior art method that the fibers experience a change of direction, which is caused by the air flow, at the periphery of the toothed roller; this can be effected only with inadequate regularity. As a result, the fibers are placed in dissimilar or irregular positions on the subsequently arranged suction drum, and thus they also have an uneven density. This uneven or irregular density produces undesired unevenness in the yarn, especially if the processed fibers have a relatively short staple length, for example as experienced in cotton spinning.

Also from the German Published Pat. No. 2,943,063 it is known to the art to separate fibers from a body of fibers by means of a drum equipped with clothing having teeth or needles, and to transfer the fibers to an air stream. At the end of this air stream, the fibers are delivered into the converging space of two drums rotating with the same rotational direction, where the fibers are then twisted together and withdrawn as yarn. One of the two drums is a perforated suction drum in order to provide the fibers with the previously mentioned possibility of twisting in of the fibers.

The disadvantage of this prior art method and apparatus is that upon their arrival in the converging space the fibers must be decelerated from the high transport speed in the air stream practically to zero speed. This fiber deceleration can lead to longitudinal compression of the fibers and therefore to a non-drawn-out condition of the fibers in the yarn.

SUMMARY OF THE INVENTION

Therefore, with the foregoing in mind it is an important object of the present invention to provide an improved method and apparatus for the production of a yarn or the like in a manner avoiding the aforementioned drawbacks and limitations of the prior art.

It is another important object of the present invention to avoid these afore-described disadvantages and to provide a new and improved method and apparatus in which the fibers have a substantially drawn-out or elongate condition when they are twisted into the yarn, and in which the fibers have a substantially even density.

Still a further significant object of the present invention is to provide an improved method and apparatus for the production of an improved quality spun yarn or the like in a highly efficient and economical manner.

Yet a further noteworthy object of the present invention is the provision of an improved yarn production apparatus which is relatively simple in its construction and design, highly reliable in operation, not readily subject to breakdown or malfunction, and requires a minimum of maintenance and servicing.

Now in order to implement these and still further objects of the invention, which will become more readily apparent as the description proceeds, the method of the present development is manifested by the features that the fibers are guided mechanically over substantially their entire path of travel from the body of fibers until reception or take-up by the friction spinning means.

As alluded to above the invention is not only concerned with the aforementioned method aspects, but also relates to an improved apparatus for the production of a yarn, and which apparatus is manifested by the features that the means for delivering the fibers is arranged so close to the friction spinning means that the fibers to be received or taken up by the friction spinning means are mechanically guided by the delivery means until such fiber take-up by the friction spinning means.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
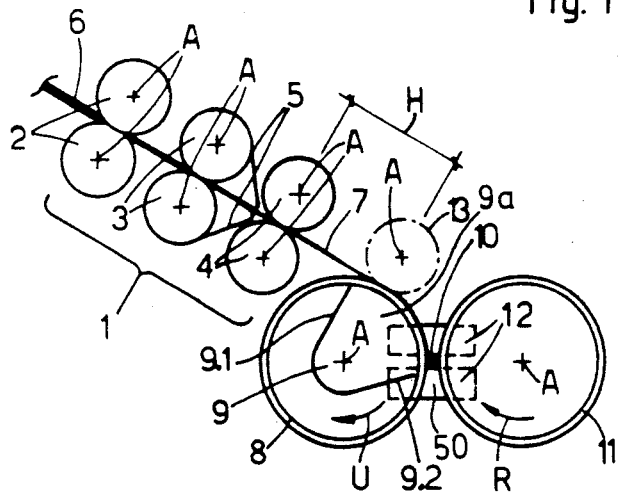
FIG. 1 depicts, part-schematically illustrated, a section through a first exemplary embodiment of apparatus constructed in accordance with the teachings of the present invention.
Figure 2:
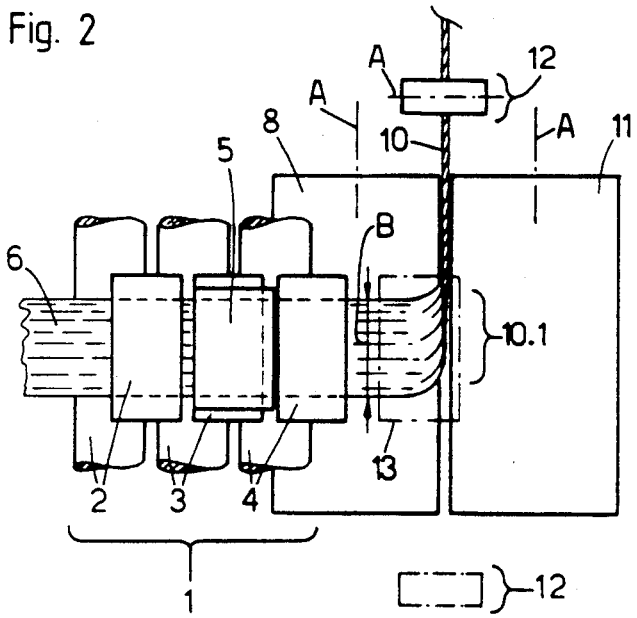
FIG. 2 is a plan view of the apparatus of FIG. 1.

Describing now the drawings, it is to be understood that only enough of the details of the construction of the different exemplary embodiments of the inventive yarn production apparatuses have been conveniently shown in the drawings as needed for those skilled in the art to understand the underlying principles and concepts of the present development while simplifying the illustration of the drawings. Turning attention now to the drawings, FIGS. 1 and 2 show a drafting mechanism 1 with an infeed roller pair 2, an intermediate roller pair 3 and an exit or delivery roller pair 4 defining an outlet side of the drafting mechanism 1. The intermediate roller pair 3 is provided in known manner with an apron pair 5. The drafting mechanism 1 processes a fiber sliver 6 or the like and delivers a correspondingly drawn body of fibers 7 to a first friction spinning drum 8.

This first friction spinning drum 8 is perforated so as to constitute a perforated friction spinning drum and contains a stationary suction passage or channel 9. This suction passage 9 defines or bounds, by means of its walls 9.1 and 9.2, a suction zone 9*a* at the periphery of the friction spinning drum 8. The walls 9.1 and 9.2 extend to the cylindrical internal wall or surface of the perforated friction spinning drum 8.

By means of the air stream or flow produced by the suction passage 9, the fibers of the fiber body 7 are held within the suction zone 9*a* at the corresponding surface portion of the rotating perforated friction spinning drum 8, and finally are twisted so as to form a spun yarn 10 in the boundary region of the suction zone 9*a* defined by the wall 9.2 of the suction passage 9. The perforated friction spinning drum 8 rotates in a direction indicated with the arrow U.

Twisting of the fibers and formation of the spun yarn 10 occurs in the previously described manner.

In order to assist or augment twisting-in of the fibers, a second friction spinning drum 11 is operatively associated with the first perforated friction spinning drum 8. This second friction spinning drum 11 is arranged so close to the first friction spinning drum 8 that the yarn 10 formed in the converging space 50 between the two friction spinning drums 8 and 11 is twisted to a stronger yarn than would be otherwise obtained without this second drum 11.

The direction of rotational movement R of the second friction spinning drum 11 is, as already previously mentioned, opposite to the direction of rotational movement U of the first friction spinning drum 8 at the region of closest approach of these two friction spinning drums 8 and 11.

In order to withdraw the yarn 10, a suitable withdrawal roll pair 11 is provided in a known manner near to the friction spinning drums 8 and 11 viewed in the axial direction thereof. Thereafter, the yarn 10 is wound up in any suitable and therefore not particularly shown manner.

Furthermore, in order to press the fibers more firmly against the first friction spinning drum 8, an additional pressure roller or roll 13 (indicated in FIG. 1 with chain-dot lines) can be provided. This pressure or drive roller 13 can either be driven with the same peripheral speed as the first friction spinning drum 8 or can be provided as a so-called "dragged along" or entrained roller.

In FIG. 2, it is indicated with chain-dot lines that the withdrawal roll pair 12 can also be arranged at the opposite end of the friction spinning drums 8 and 11, that is, in such case the spun yarn 10 is now withdrawn in the correspondingly opposite direction.

In operation, the fiber sliver 6 is supplied from a suitable spinning can (not shown) and is drawn in the drafting mechanism 1 to a parallelized body of fibers 7. Due to the suction effect exerted by the suction passage 9, that is due to the sucking of the fibers of the body of fibers 7 against the first friction spinning drum 8, combined with the rotation of this first friction spinning drum 8, the fibers are separated from the body of fibers 7 and, as illustrated in FIGS. 1 and 2, are fed with their yarn ends 10.1 into the converging space 50 between the two friction spinning drums 8 and 11, and at which location the fibers are then twisted to a yarn 10 which is withdrawn by the withdrawal rolls or withdrawal roll pair 12.

Since the peripheral speed of the friction spinning drums 8 and 11 is several times, for example twice to twenty times, the speed of the body of fibers 7, a strong drafting effect arises between the exit or delivery roller pair 4 and the first friction spinning drum 8. This causes, on the one hand, an additional drafting of the fibers and, on the other hand, a substantial reduction in density of the aggregation of fibers located on this friction spinning drum 8.

Through this "thinning out" and additional drafting operation, a sparse but even, loose body of staple fibers is produced which is twisted to an even yarn.

Furthermore, the withdrawal of the twisted yarn 10 by the withdrawal rolls 12 produces in the yarn 10 a drawing effect which makes the yarn 10 more dense, and the tension required for the drawing operation is produced by the friction between the yarn 10 and the friction spinning drums 8 and 11.

If the pressure roller 13 is used then it increases the friction between the first friction spinning drum 8 and the fibers grasped by this drum 8, so that the slip between these fibers and the moved surface of the friction spinning drum 8 is reduced and separation of the fibers from the body of fibers 7 is enhanced.

Figure 3:
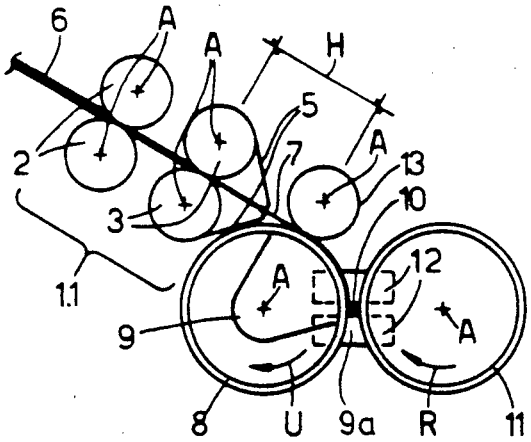
FIG. 3 shows a section, again part-schematically illustrated, through a modification of the apparatus depicted in FIG. 1 and likewise constructed according to the present invention.
Figure 4:
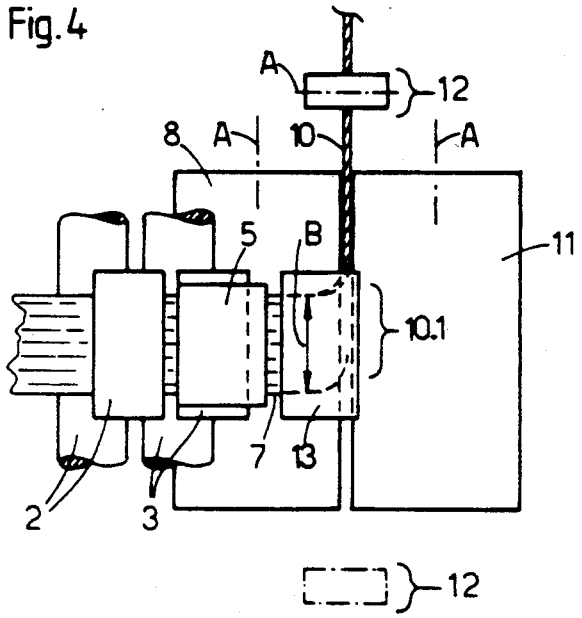
FIG. 4 shows a plan view of the apparatus of FIG. 3.

FIGS. 3 and 4 show a modification in which here the essential changes are the absence of the exit or delivery roller pair 4 and the delivery of the fibers directly onto the first friction spinning drum 8 by the apron pair 5. The resulting reduced drafting mechanism is generally indicated by reference character 1.1.

In this variant embodiment, the pressure roller 13 is fixedly operatively associated with the first friction spinning drum 8. The additional elements correspond to those of FIGS. 1 and 2 and therefore are generally indicated with the same reference numerals.

Comparison of the apparatus of FIG. 1, with and without the pressure or drive roller 13, with the apparatus of FIG. 3 shows the following with respect to guidance of the fibers of the body of fibers 7.

1. In the apparatus of FIG. 1 without the pressure or drive roller 13, apart from the already mentioned poor grasping of the fibers of the body of fibers 7 by the first friction spinning drum 8, there is the effect that the fibers tend to bunch together in the exit gap of the rotating exit or delivery roller pair 4 as a result of the air stream or flow directed against them, that is to say, the fibers are not delivered with an even distribution. These air streams, directed in opposition to each other in the axial direction of the exit or delivery rollers 4, arise, as is known, due to the under-pressure present in the exit gap of two rollers pressed against each other.

2. When using the pressure roller 13, the fibers of the body of fibers 7 are better guided, so that the aforesaid transverse air streams or flows can exert only a minimal negative influence on the guidance of the fibers.

In the use of the apparatuses of FIGS. 1 and 3 with the pressure roller 13, there is the requirement that the spacing H (FIG. 1) between the nip of the exit or delivery rollers 4 and the nip of the first friction spinning drum 8 formed in conjunction with the pressure roller 13 must not be less than the length of the longest fiber to be processed in order to avoid tearing of the fibers; in the use of the apparatus without the pressure roller 13, the spacing H must not exceed the aforesaid longest length, in order to ensure that the fibers are grasped by the friction spinning drum 8.

3. In the variant embodiment illustrated in FIG. 3, in comparison with the two previously mentioned embodiments, the advantage is obtained that the fibers are guided more closely towards the nip point between the first friction spinning drum 8 and the pressure roller 13, so that a transverse air flow has practically no influence, and thus, the distribution of the fibers remains even over the entire width B of the body of fibers 7 (FIGS. 2 and 4).

Figure 5:
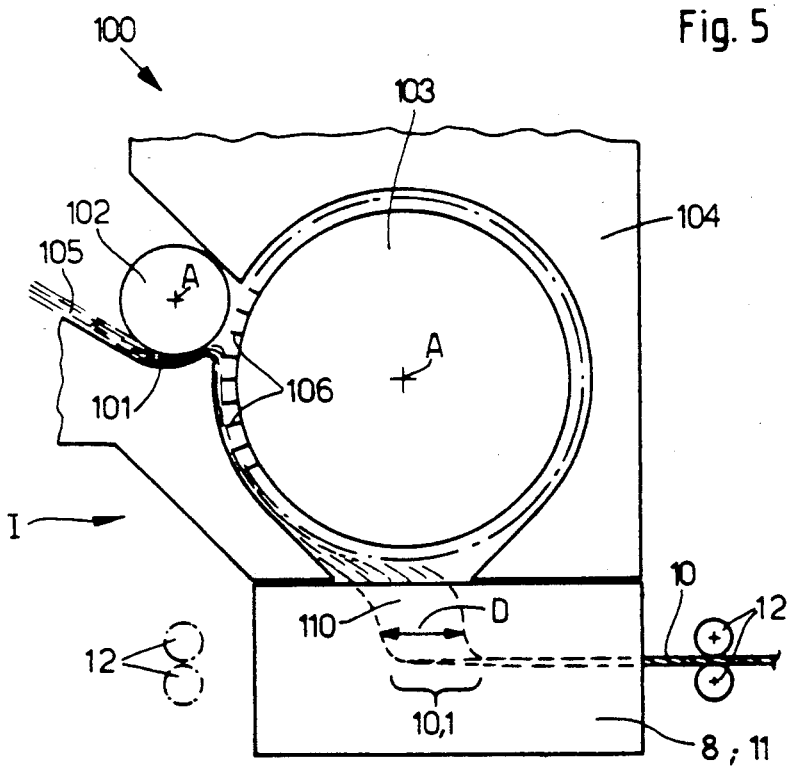
FIG. 5 shows a section, part-schematically illustrated, through a further exemplary embodiment of yarn production apparatus constructed according to the present invention.

The further embodiment of apparatus which is likewise constructed according to the invention, as illustrated in FIG. 5, has an opening assembly 100 which feeds the fibers onto the friction spinning drum 8 or 11, respectively.

This opening assembly 100 comprises a feed shoe 101, a feed roll or roller 102 and an opening roller 103. The feed roll 102 and the opening roller 103 are rotatably supported in a housing 104 and are drivable by any suitable drive means.

In order to feed a fiber sliver 105 along the feed shoe 101 towards the opening roller 103, the feed roll 102 is provided with longitudinal flutes (not shown). The opening roller 103 is provided in known manner with needles 106 or teeth (not shown) for opening of the fiber sliver 105. Such opening assemblies are known from rotor, open-end spinning and therefore need not here be further described.

Figure 6:
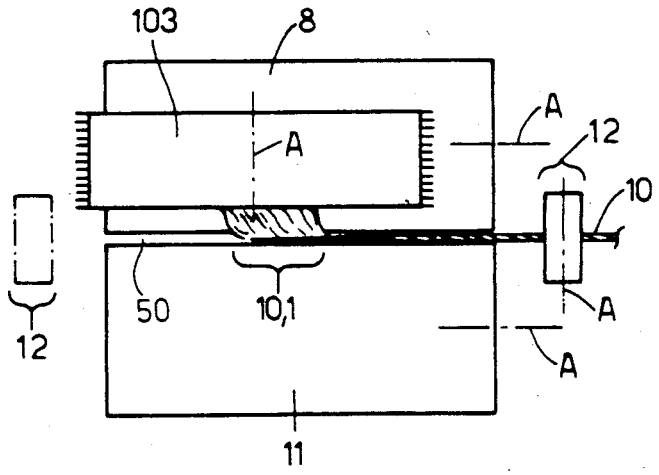
FIG. 6 shows in plan view a detail of the apparatus of FIG. 5.
Figure 7:
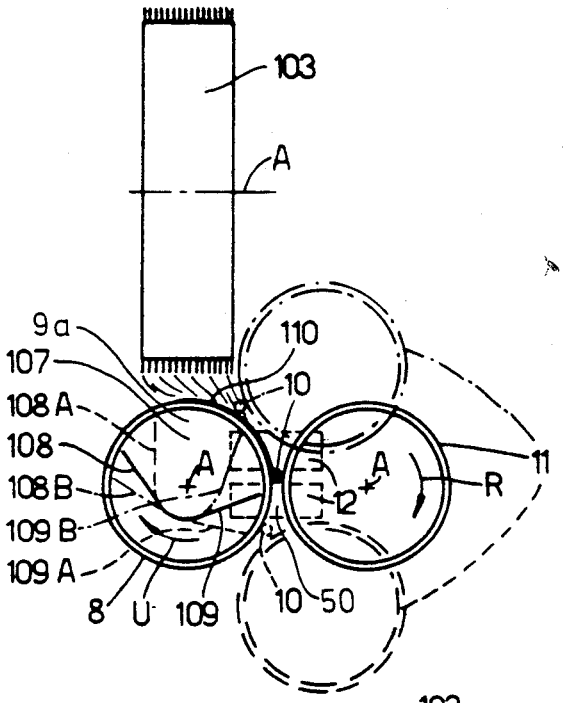
FIG. 7 shows the apparatus of FIG. 5, depicted in section and illustrated looking in the direction of the arrow I of FIG. 5.

FIG. 6 schematically shows selected elements in plan view, and FIG. 7 schematically shows selected elements in side view of the apparatus depicted in FIG. 5. In FIG. 6 and in FIG. 7, the housing 104 and the feed roll 102 have been conveniently omitted for clarity of illustration.

FIG. 7 also shows a suction passage or channel 107 located within the first perforated friction spinning drum 8. This suction passage 107 has side walls 108 and 109 which extend to the inner cylindrical wall of the first friction spinning drum 8. As already previously described, the walls 108 and 109 define or delimit the suction zone **9*a* of the first friction spinning drum 8**.

In operation, the feed roll 102 moves the fiber sliver 105 towards the needles 106 of the opening roller 103, so that this opening roller 103, which rotates at high speed, separates fibers from the body of fibers 7 by means of the needles 106, and feeds these separated fibers to the first friction spinning drum 8. There arises thereby a fiber stream 110 which, as shown in FIG. 5, has a certain width or breadth D. This width D is variable in dependence upon the relationship of the infeed speed of the fiber sliver 105 and the peripheral or circumferential speed of the opening roller 103.

The fibers of the fiber stream 110 pass, while located upon the outer surface of the first friction spinning drum 8, with their yarn ends 10.1 into the converging space 50 between the two friction spinning drums 8 and 11, respectively, in which the yarn 10 is formed in known manner.

As in the preceding apparatus constructions, the yarn 10 is withdrawn by the withdrawal roller pair 12.

As represented in FIG. 7 with broken and with chain-dot lines, respectively, the second friction spinning drum 11 can assume a lower or a higher elevational position, as the case may be, relative to the first friction spinning drum 8.

By means of this change of position, the location of twisting-in of the fibers can be adapted, for example, to the fiber length of the fibers to be processed. This means that with longer fibers the second friction spinning drum 11 is moved downwardly, whereas with shorter fibers it is moved upwardly, that is towards the opening roller 103.

The suction passage or channel 107 must also be moved upon a change of position of the second friction spinning drum 11, so that the wall 109 assumes the position 109A or the position 109B, respectively, and the wall 108 assumes the position 108A or the position 108B, respectively.

In order to avoid any excessively high air consumption due to unnecessarily drawn in air, the suction passage or channel 107 can be replaced upon each change in the position of the second friction spinning drum 11, so that the position of the wall 108A is constant for all three variants.

Furthermore, it can be seen from FIG. 5 that the withdrawal roller pair 12 can be arranged, as a possible modification of the invention, on the opposite end face of the friction spinning drums 8 and 11, whereby the spun yarn 10 is withdrawn in the correspondingly opposite direction.

In the variant of FIG. 7, the fibers delivered by the opening roller 103 are further subjected, during their reception or taking up by the friction spinning drums or rollers 8 and 11, to a deflection or diversion which assists in drawing-out of the fibers.

Figure 8:
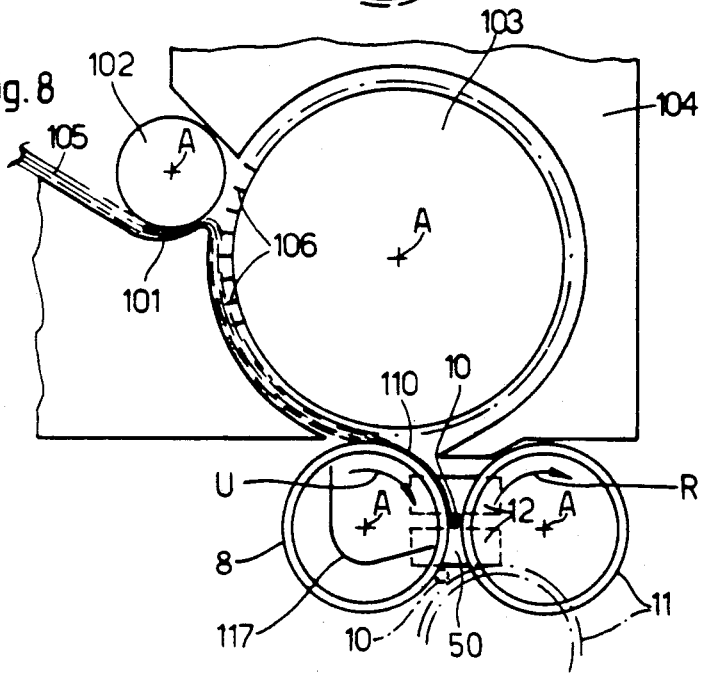
FIG. 8 shows a further modification of the apparatus of FIG. 5, part-schematically illustrated.

FIG. 8 shows a further variant of the apparatus of FIG. 5 in which the axis of rotation of the opening roller 103 lies substantially parallel to the axes of rotation of the friction spinning drums 8 and 11.

The drawing-out of the fibers during transfer from the opening roller 103 to the first friction spinning drum 8 also occurs in the variant embodiments working with an opening roller 103 due to the higher peripheral speed of the friction spinning drum 8 relative to the fiber speed in the region of the transfer location or position. A slightly higher peripheral speed of the friction spinning drum 8 is sufficient to produce an adequate drawing-out action upon the fibers. From the position of the second friction spinning drum 11 indicated in chain-dot lines it can be seen that, in this variant also, the position of the converging space 50 in which the yarn 10 is produced can be adapted to the fibers to be processed. The suction passage or channel 117 must be correspondingly adapted.

Figure 9:
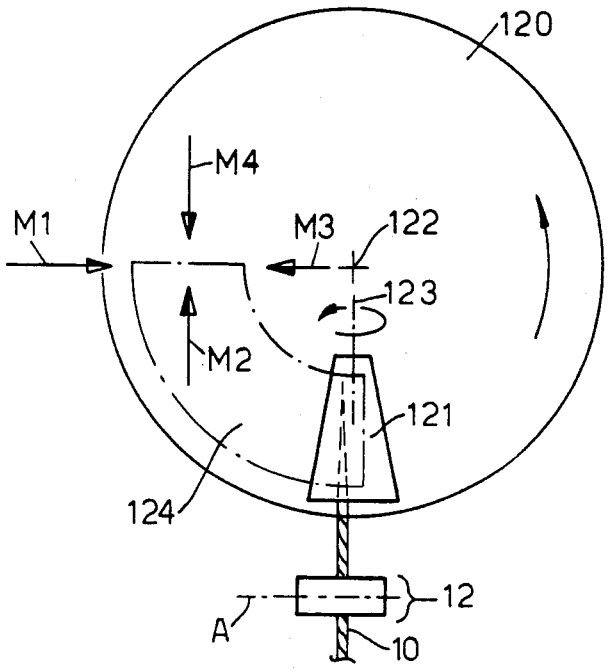
FIG. 9 shows, part-schematically illustrated, a modification of a part of the apparatuses constructed according to the present invention.

Finally, FIG. 9 shows an arrangement using a friction spinning disc 120 receiving fibers separated from the body of fibers in place of the first friction spinning drum 8, and also a friction spinning cone (frusto-cone) 121 in place of the second friction spinning drum 11. Both elements 120 and 121 are appropriately drivable by any suitable drive means (not shown) and rotate about respective axes 122 (indicated with a cross) and 123 (indicated with a dotted line).

The friction spinning disc 120 is perforated and, due to the provision of a suitable suction passage (not shown) located beneath this friction spinning disc, an air stream passes through the region 124 indicated by dotted lines.

This principle is known from British Pat. No. 1,231,198 to which reference may be had and the teachings of which are incorporated herein by reference.

In accordance with the invention, this principle is combined with the drafting mechanism 1 or 1.1 of FIGS. 1 and 2 or 3 and 4, respectively, or with the opening assembly 100 of FIG. 5 in such manner that the delivery of fibers to the friction spinning disc 120 is effected in one of the directions M.1 to M.4 or in any direction lying between those two directions.

In any event, the lowest peripheral speed of the friction spinning disc 120 in region 124 is greater than the fiber delivery speed, so that the fibers are drawn out during reception or take-up by the friction spinning disc 120.

Due to the mechanical guidance of the fibers up to the stage at which a spun yarn is formed, the advantage is also obtained in this case that the distribution of the fibers in the flow of fiber sliver remains substantially constant, and that the fibers substantially maintain throughout the entire path of travel thereof the disposition or position assumed on the first friction spinning drum or friction spinning disc.

In all of the embodiments herein disclosed, the means for delivering the fibers, whether such be constituted by a drafting arrangement or an opening roll, advantageously, are arranged such that the fibers are either delivered in a direction which is disposed essentially parallel to the direction of movement of the related perforated moveable surface of the friction spinning means at a location of transfer of the fibers from the drafting arrangement or the opening roll, as the case may be, to the perforated moveable surface or in a direction which is disposed intermediate the aforesaid direction and a direction extending essentially at right angles to the direction of movement of the perforated moveable surface, i.e. a direction substantially parallel to the lengthwise axis of the perforated moveable surface.

Finally, the drive and the support of all rotating elements or components is known and therefore not subject matter of the invention; for simplicity, it has not been described in detail but indicated only schematically by the axes A, 122 and 123, respectively. Also for reasons of representational simplicity, the suction passage has not been shown in FIGS. 2, 4, 5 and 6; it is however known that such stationarily arranged suction passage projects into the friction spinning drum at the non-supported end thereof. The supported end is indicated by the axes A of the related friction spinning drum in FIGS. 2, 4 and 6.

While there are shown and described present preferred embodiments of the invention, it is to be distinctly understood that the invention is not limited thereto, but may be otherwise variously embodied and practiced within the scope of the following claims.

Accordingly, what I claim is:

1. A method for the production of a yarn or the like, comprising the steps of:

separating fibers from a body of fibers;

feeding the separated fibers continuously along a predetermined path of travel in the direction of friction spinning means moving in a predetermined direction of movement;

mechanically guiding the fibers throughout said entire path of travel of the separated fibers from the body of fibers until reception by the friction spinning means;

directly receiving the fibers from the body of fibers at the friction spinning means in such a manner that a front end of the fibers, viewed in the direction of fiber travel, is already engaged by the friction spinning means during such time as a rear end of the fibers has not yet departed from the body of fibers;

transferring the mechanically guided and separated fibers to the friction spinning means;

forming a spun yarn at the friction spinning means; and withdrawing the spun yarn in a direction governed by the friction spinning means.

2. The method as defined in claim 1, further including the steps of:

transferring the fibers to the friction spinning means in a direction which is disposed substantially parallel to the predetermined direction of movement of the friction spinning means.

3. The method as defined in claim 1, further including the steps of:

transferring the fibers to the friction spinning means in a direction which is disposed intermediate a direction extending essentially parallel to the predetermined direction of movement of the friction spinning means and a direction extending essentially at right angles to the predetermined direction of movement of the friction spinning means.

4. A method for the production of a yarn or the like, comprising the steps of:

separating fibers from a body of fibers;

feeding the separated fibers continuously along a predetermined path of travel in the direction of friction spinning means moving in a predetermined direction of movement;

mechanically guiding the fibers throughout said entire path of travel of the separated fibers from the body of fibers until reception by the friction spinning means;

directly receiving the fibers from the body of fibers at the friction spinning means in such a manner that a front end of the fibers, viewed in the direction of fiber travel, is already engaged by the friction spinning means during such time as a rear end of the fibers has not yet departed from the body of fibers;

transferring the mechanically guided and separated fibers to the friction spinning means;

operating the friction spinning means at a higher speed than the speed of travel of the separated fibers to be received by the friction spinning means;

drawing-out the fibers during such time as the fibers are received at the friction spinning means;

forming a spun yarn at the friction spinning means; and withdrawing the spun yarn in a direction governed by the friction spinning means.

5. A method for the production of a yarn or the like, comprising the steps of:

separating fibers from a body of fibers by opening means operating substantially in accordance with an open-end spinning process;

feeding the separated fibers continuously along a predetermined path of travel in the direction of friction spinning means moving in a predetermined direction of movement;

mechanically guiding the fibers throughout substantially said entire path of travel of the separated fibers from the body of fibers until reception by the friction spinning means;

thereafter directly receiving the separated fibers at the friction spinning means in such a manner that a front end of the fibers, as viewed in the direction of fiber travel, is already entrained by the friction spinning means when a rear end of the fibers has not yet left the opening means;

transferring the mechanically guided and separated fibers to the friction spinning means;

forming a spun yarn at the friction spinning means; and withdrawing the spun yarn in a direction governed by the friction spinning means.

6. The method as defined in claim 5, further including the steps of:

transferring the fibers to the friction spinning means in a direction which is disposed substantially parallel to the predetermined direction of movement of the friction spinning means.

7. The method as defined in claim 5, further including the steps of:

transferring the fibers to the friction spinning means in a direction which is disposed intermediate a direction extending essentially parallel to the predetermined direction of movement of the friction spinning means and a direction extending essentially at right angles to the predetermined direction of movement of the friction spinning means.

8. A method for the production of a yarn or the like, comprising the steps of:

separating fibers from a body of fibers by opening means operating substantially in accordance with an open-end spinning process;

feeding the separated fibers continuously along a predetermined path of travel in the direction of friction spinning means moving in a predetermined direction of movement;

mechanically guiding the fibers throughout substantially said entire path of travel of the separated fibers from the body of fibers until reception by the friction spinning means;

thereafter directly receiving the separated fibers at the friction spinning means in such a manner that a front end of the fibers, as viewed in the direction of fiber travel, is already entrained by the friction spinning means when a rear end of the fibers has not yet left the opening means;

transferring the mechanically guided and separated fibers to the friction spinning means;

operating the friction spinning means at a higher speed than the speed of travel of the separated fibers to be received by the friction spinning means;

drawing-out the fibers during such time as the fibers are received at the friction spinning means;

forming a spun yarn at the friction spinning means; and withdrawing the spun yarn in a direction governed by the friction spinning means.

9. An apparatus for the production of a yarn or the like, comprising:

means for delivering fibers from a body of fibers;

said means for delivering fibers comprises an opening roller;

friction spinning means for receiving the delivered fibers from the opening roller and for forming therefrom a spun yarn;

said delivering means for the delivering of the fibers being arranged sufficiently close to the friction spinning means that the fibers to be received at and by the friction spinning means are mechanically guided by said delivering means until reception by said friction spinning means in a substantially drawn-out condition; and means for withdrawing the spun yarn.

10. The apparatus as defined in claim 9, wherein:

said friction spinning means comprises at least one perforated moving surface moveable in a predetermined direction;

means defining a suction zone located in said perforated moving surface; and said suction zone defining means being provided at said at least one perforated surface such that a front end of the fibers already released by said fiber delivering means is entrained by a suction air stream and delivered to said at least one perforated moving surface.

11. The apparatus as defined in claim 10, further including:

a further moving surface moving in a direction opposite to the direction of movement of said at least one perforated moving surface to assist twisting of the fibers into the spun yarn.

12. The apparatus as defined in claim 11, wherein:

said at least one perforated moving surface is the surface of a first cylinder; and

13. The apparatus as defined in claim 10, wherein:

said at least one perforated moving surface is the surface of a disc.

14. The apparatus as defined in claim 10, further including:

a further moving surface moving in a direction opposite to the direction of movement of said at least one perforated moving surface to assist twisting of the fibers into the spun yarn; and said further moving surface is the rotation surface of a frusto-cone.

15. The apparatus as defined in claim 10, wherein:

said at least one perforated moving surface is the rotation surface of a cylinder.

said further moving suface is the surface of a second cylinder.

16. The apparatus as defined in claim 10, wherein:

said means for delivering fibers are arranged in such a manner that the fibers are delivered in a direction which is disposed essentially parallel to the direction of movement of said at least one perforated moveable surface.

17. The apparatus as defined in claim 10, wherein:

said means for delivering fibers are arranged in such a manner that the fibers are delivered in a direction which is disposed essentially at right angles to the direction of movement of said at least one perforated moveable surface.

18. The apparatus as defined in claim 10, wherein:

said means for delivering fibers are arranged in such a manner that the fibers are delivered in a direction which is disposed intermediate a direction extending essentially parallel to the direction of movement of said at least one perforated moveable surface and a direction extending essentially at right angles to the direction of movement of said at least one perforated moveable surface

19. An apparatus for the production of a yarn or the like, comprising:

means for delivering fibers from a body of fibers and including an opening roll;

friction spinning means for receiving the delivered fibers from the opening roll and for forming therefrom a spun yarn;

said means for delivering fibers comprising said opening roll cooperating with said friction spinning means for imposing a drafting effect on said fibers;

said opening roll for the delivering of the fibers being arranged sufficiently close to the friction spinning means that the fibers to be received at and by the friction spinning means are mechanically guided by said opening roll until reception by the friction spinning means in a substantially drawn-out condition; and means for withdrawing the spun yarn.

20. The apparatus as defined in claim 19, wherein:

said friction spinning means comprises at least one perforated moving surface moveable in a predetermined direction;

means defining a suction zone located in said perforated moving surface; and said suction zone defining means being provided at said at least one perforated surface such that a front end of the fibers already released by said fiber delivering means is entrained by a suction air stream and delivered to said at least one perforated moving surface at a predetermined location of deposition.

21. The apparatus as defined in claim 20, wherein:

said means for delivering fibers are arranged in such a manner that the fibers are delivered from the opening roll at the predetermined location of deposition of the fibers at the at least one perforated moveable surface in a direction which is disposed essentially parallel to the direction of movement of said at least one perforated moveable surface.

22. The apparatus as defined in claim 20, wherein:

said means for delivering fibers are arranged in such a manner that the fibers are delivered in a direction which is disposed substantially parallel to the predetermined direction of movement of said at least one perforated moveable surface.

23. The apparatus as defined in claim 20, wherein:

said means for delivering fibers are arranged in such a manner that the fibers are delivered in a direction which is disposed intermediate a direction extending substantially parallel to the direction of movement of said at least one perforated moveable surface and a direction extending substantially at right angles to the direction of movement of said at least one perforated moveable surface.

* * * * *

UNITED STATES PATENT AND TRADEMARK OFFICE

CERTIFICATE OF CORRECTION

PATENT NO. : 4,783,956

DATED : November 15, 1988

INVENTOR(S) : HERBERT STALDER

It is certified that error appears in the above-identified patent and that said Letters Patent is hereby corrected as shown below:

Title Page under the heading United States Patent, please delete "Stadler" and insert --Stalder--

After the title "Inventor: Herbert" please delete "Stadler" and insert --Stalder--

Column 4, line 37, please delete "11" and insert --12--

Column 11, line 18, insert --said further moving surface is the surface of a second cylinder--

Column 11, line 33, please delete lines 33 and 34.

Signed and Sealed this

Sixth Day of June, 1989

*Attest:*

*Attesting Officer*

DONALD J. QUIGG

*Commissioner of Patents and Trademarks*